United States Patent [19]

Emery

[11] Patent Number: 4,827,853

[45] Date of Patent: May 9, 1989

[54] DRYING OF METAL HYDROXIDE SLUDGE

[75] Inventor: Michael F. Emery, Milwaukee, Wis.

[73] Assignee: Oven Systems, Inc., New Berlin, Wis.

[21] Appl. No.: 171,970

[22] Filed: Mar. 23, 1988

[51] Int. Cl.[4] ..... F23G 5/02

[52] U.S. Cl. ..... 110/223; 34/39; 34/208; 110/228

[58] Field of Search ..... 110/218, 219, 223, 224, 110/227, 228, 250, 346; 34/21, 39, 105, 208, 218, 219; 100/92, 92 R

[56] References Cited

U.S. PATENT DOCUMENTS

| | | | |
|---|---|---|---|
| 2,096,176 | 10/1937 | Harrington | 110/228 X |
| 3,156,198 | 11/1964 | Koch | 110/224 X |
| 3,253,345 | 5/1966 | Kowalik | 34/208 |
| 3,613,564 | 10/1971 | Ademski et al. | 110/223 X |
| 3,744,145 | 7/1973 | Maxwell et al. | 110/227 X |
| 4,067,318 | 1/1978 | Flaith et al. | 34/208 |
| 4,393,603 | 7/1963 | Casperson | 34/39 |
| 4,643,108 | 2/1987 | Singelyn et al. | 110/228 |

OTHER PUBLICATIONS

William L. Root, III, "Indirect Drying of Solids", Chemical Engineering, May 2, 1983, pp. 52–64.

JWI, Inc., "Metal Hydroxide Sludge Volume Reducers", 5/87/5M.

*Primary Examiner*—Steven E. Warner

*Attorney, Agent, or Firm*—Andrus, Sceales, Starke & Sawall

[57] ABSTRACT

Initially moist metal hydroxide sludge is formed into a suitable mass, such as sludge cakes (2) which are fed downwardly in a hopper (1) and pressed into the cells (7) of a multi-cellular moving metal belt (5) in a two-stage process. The first stage deposits the sludge roughly into the cells, while the second stage compresses and compacts the deposited sludge tightly into the cells so that the sludge is in intimate contact with the cell walls throughout each cell. The sludge-filled belt is passed through a dryer (3) whereby the belt is subject to indirect, rather than direct, heating. More particularly, the belt passes through an enclosed muffle (21) and is caused to be in direct heat-exchanging contact with the bottom muffle wall (23). The latter wall is heated from beneath and outside the muffle chamber, as by heated air jets. The heat from this wall is not only conducted into the bottom of the sludge passing thereacross, but also into the cell walls of the metal belt itself and hence to the sides of the sludge pieces.

8 Claims, 3 Drawing Sheets

FIG. 4
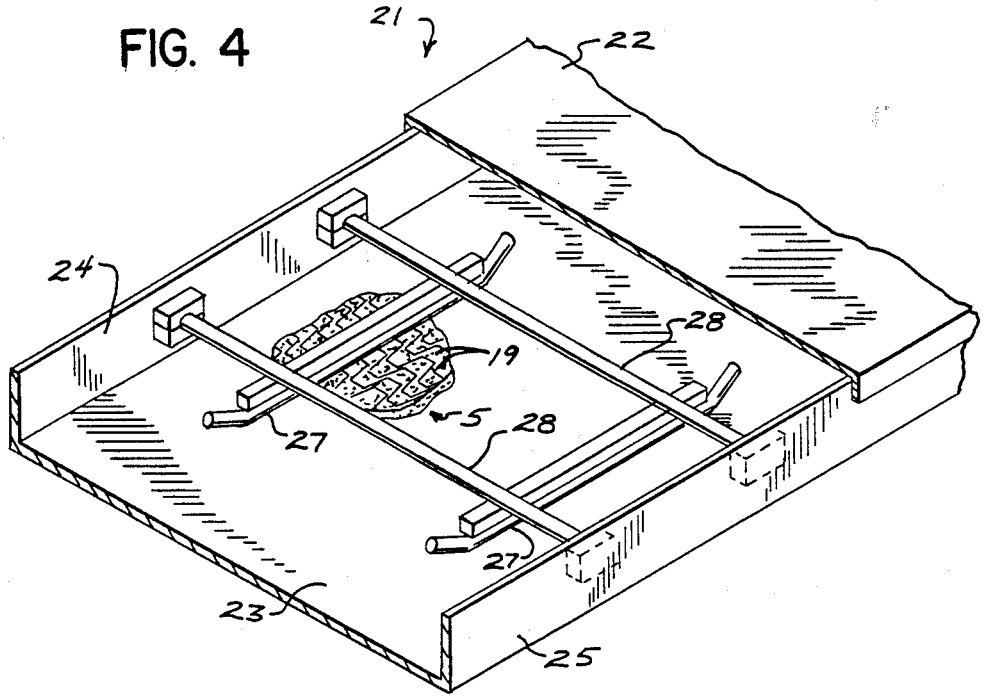
FIG. 5
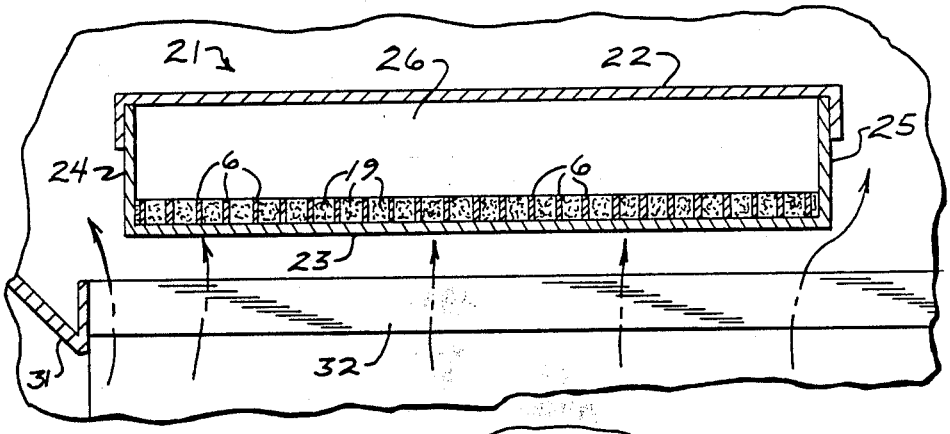
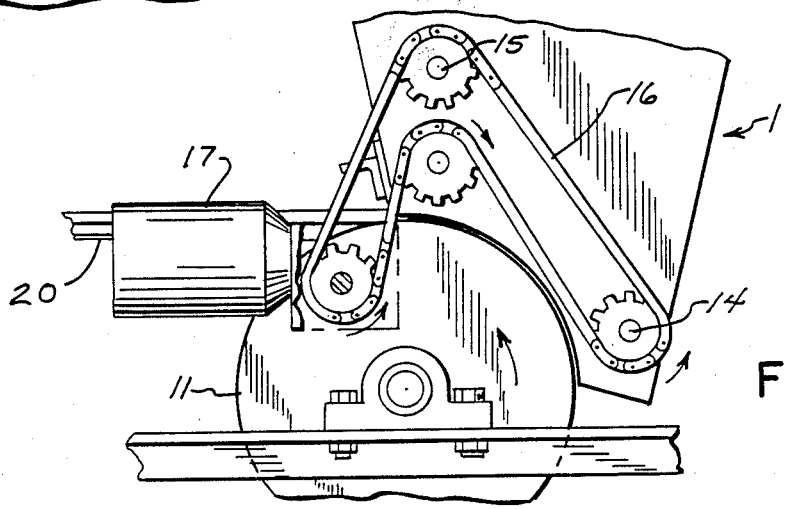
FIG. 6

DRYING OF METAL HYDROXIDE SLUDGE

BACKGROUND AND SUMMARY OF THE INVENTION

This invention relates to drying of sludge, and particularly metal hydroxide sludge. Such sludge is a by-product of metal platers and the like, and in its initial form often contains up to as much as 90 percent moisture. For purposes of disposal, it is desired to reduce the moisture content and thus the volume of the sludge.

Heretofore, it has often been the practice to deposit the sludge loosely onto a moving cellular belt and then to pass the belt through an oven wherein the sludge has been subjected to direct heat, such as an open flame directed onto the sludge. This, of course, dehydrates the sludge and reduces its volume.

In recent years it has been determined that metal hydroxide sludge can be a hazardous waste in that it contains minute quantities of heavy metals such as nickel, cadmium, lead, zinc etc. The prior drying systems, such as discussed above, heat the sludge to a very high degree, which can be in excess of 1000 degrees F., causing the metals therein to vaporize into toxic gases. This is unacceptable from an environmental and health standpoint.

It is an object of the invention to improve the manner of deposition of the sludge onto a moving cellular belt. It is a further object of the invention to provide for drying of hazardous sludge in a manner so that the formation of toxic gases is essentially eliminated.

In accordance with the various aspects of the invention, the initially moist sludge is formed into a suitable mass, such as sludge cakes which are fed downwardly in a hopper and pressed into the cells of a multi-cellular moving metal belt in a two-stage process. The first stage deposits the sludge roughly into the cells, while the second stage compresses and compacts the deposited sludge tightly into the cells so that the sludge is in intimate contact with the cell walls throughout each cell.

Furthermore, the sludge-filled belt is passed through a dryer whereby the belt is subject to indirect, rather than direct, heating. More particularly, the belt passes through an enclosed muffle and is caused to be in direct heat-exchanging contact with the bottom muffle wall. The latter wall is heated from beneath and outside the muffle chamber, as by heated air jets. The heat from this wall is not only conducted into the bottom of the sludge passing thereacross, but also into the cell walls of the metal belt itself and hence to the sides of the sludge pieces. The result is efficient sludge drying at acceptably low temperatures.

BRIEF DESCRIPTION OF THE DRAWINGS

The accompanying drawings illustrate the best mode presently contemplated by the inventor for carrying out the invention.

In the drawings:

FIG. 4 is a perspective view of the belt hold-down mechanism;

FIG. 5 is an enlarged generally vertical section taken on line 5—5 of FIG. 1;

FIG. 6 is a view of the sludge hopper drive mechanism;

DESCRIPTION OF THE PREFERRED EMBODIMENT

Figures 1, 7, 8, 9:
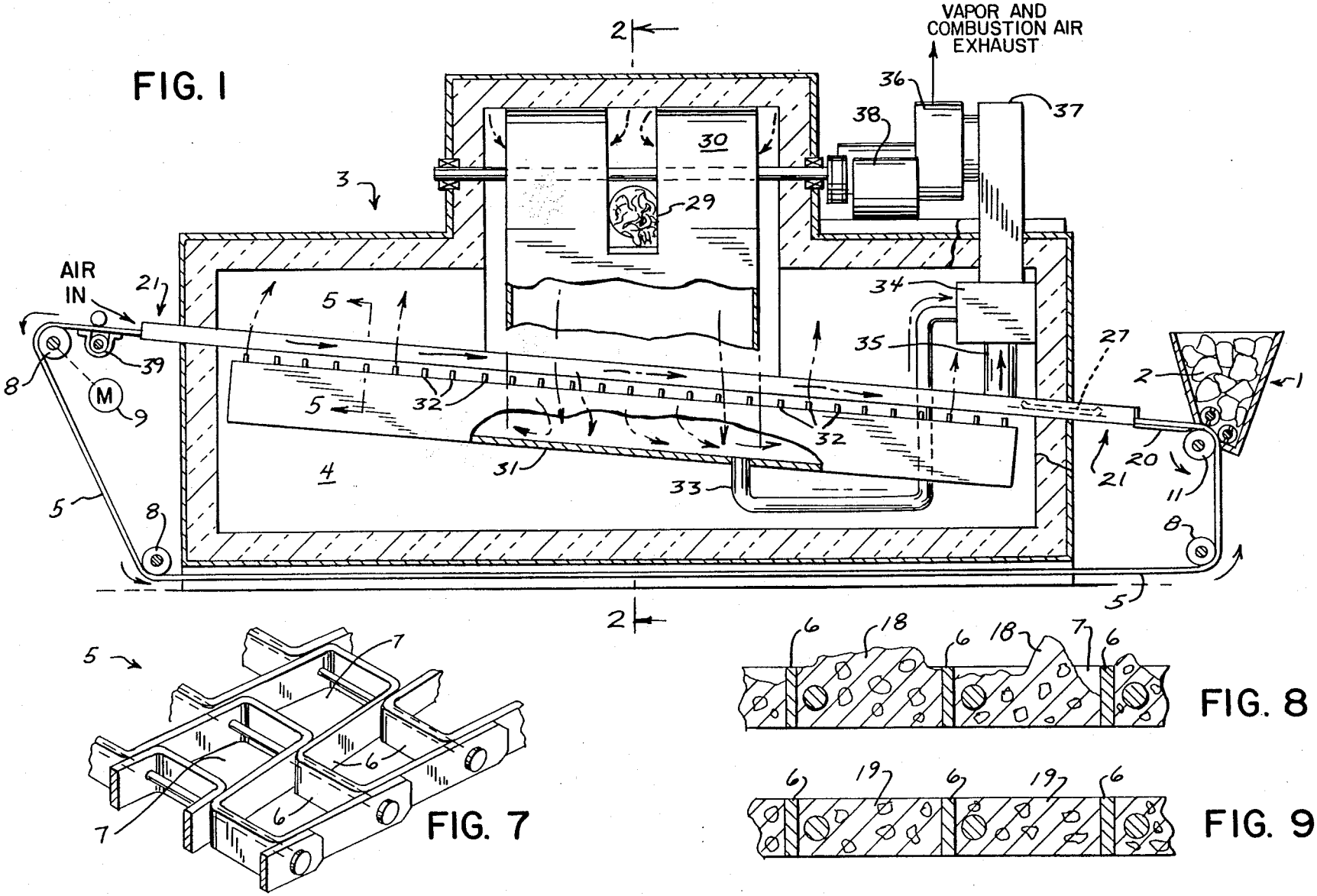
FIG. 1 is a schematic longitudinal showing of a sludge drying device which incorporates the various aspects of the invention, with parts broken away and in section.
FIG. 7 is an enlarged fragmentary perspective view of the cellular metal conveyor belt.
FIG. 8 is an enlarged fragmentary section of the conveyor belt after the first stage of sludge deposition.
FIG. 9 is a view similar to FIG. 8 subsequent to the second state.

The various aspects of the invention are directed to the drying of metal hydroxide sludge and the like. As shown in the drawings, and generally, a hopper 1 is provided for receiving and dispensing a mass of moist sludge which in the present embodiment comprises a plurality of sludge cakes 2. Cakes 2 normally comprise about 10–40 percent solids, with the rest being moisture. A heating zone forming oven 3 is disposed downstream of hopper 1 and forms a generally enclosed oven chamber 4. An endless conveyor belt 5 of hinged metallic chain-like construction has a plurality of upstanding belt walls 6 forming a plurality of cells 7. See FIG. 7. Belt 5 is trained over a plurality of sprocket rollers 8, one of which serves as a driving roller via a connected motor 9. Belt 5 is adapted to carry sludge from hopper 1 and through oven 3, as will be described.

Figure 3:
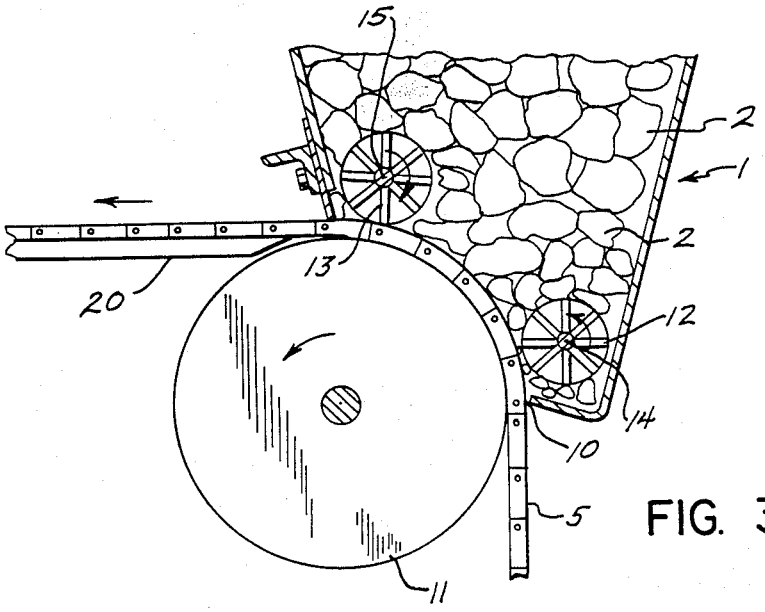
FIG. 3 is an enlarged side view of the sludge depositing hopper and associated mechanism.

Referring to FIGS. 1, 3, and 6–8, means are provided at the bottom of hopper 1 to provide more uniform consistency of sludge cakes 2 and to squeezingly compact the sludge tightly into cells 7 of belt 5. For this purpose, the bottom discharge opening 10 of hopper 1 is formed to receive a rotary drum 11 over which belt 5 passes. Disposed within the bottom of the hopper and closely adjacent drum 11 are a pair of rotary paddles 12 and 13. As best shown in FIGS. 3 & 6, paddles 12 and 13 are mounted on shafts 14 and 15 respectively, with the latter being suitably driven as by a chain drive 16 connected to a controllable motor 17.

As best shown in FIG. 3, paddle 12 is disposed in the lowermost portion of hopper 1 and is spaced slightly from belt 5. As paddle 12 is rotated in a first stage of operation, sludge cakes 2 are kneaded and the mass is pushingly deposited into cells 7 and against drum 11 but, as shown in FIG. 8, the resultant mass 18 is somewhat loosely contained in the cells. Paddle 13 is disposed counterclockwise from paddle 12 along belt 5 and is disposed slightly closer to the latter. As drum 11 rotates with the belt and paddle 13 rotates in a second stage of operation, the mass of sludge originally deposited by paddle 12, as in FIG. 8, is further compressed and tightly compacted into cells 7 and against drum 11 so that the cells are filled with moist sludge nuggets 19 which are in intimate contact with walls 6 of belt 5. See FIG. 9. The belt with nuggets 19 then passes downstream and over a support plate 20 towards oven 3.

Subsequent to the compacting of sludge into belt 5, moisture is removed from sludge nuggets 19 by the application of indirect heat. In the illustrated embodiment, a longitudinal elongated generally enclosed muffle 21 extends from closely adjacent support plate 20 and down stream through a confined opening in the upstream oven wall, through oven chamber 4, and discharges through a confined opening in the downstream oven wall. Muffle 21 is preferably metallic and comprises generally planar top and bottom walls 22 and 23, which are joined by upstanding side walls 24 and 25, thus forming a box-like enclosure defining an inner muffle chamber 26. More than one belt 5 and muffle 21 may be handled at the same time, as suggested by the phantom showing at 21*a* in FIG. 2.

The assembly of belt 5 and sludge nuggets 19 is adapted to move downstream from hopper 1 and support plate 20, and hence through muffle 21 within oven 3, with final discharge at the downstream oven end. While within muffle chamber 26, the assembly is basically isolated from oven chamber 4 and rides along in intimate contact with bottom muffle wall 23.

As the said assembly enters the upstream portion of muffle 21, it is subjected to a hold-down force which in the present embodiment is created by a pair of spaced longitudinally extending ski-like rails 27 which are suspended from transverse rods 28 mounted to side walls 24 and 25. See FIGS. 1 and 4. A second pair of rails 27, not shown, are also disposed downstream of the first pair. The weight of the assembly maintains its contact with wall 23.

Figure 2:
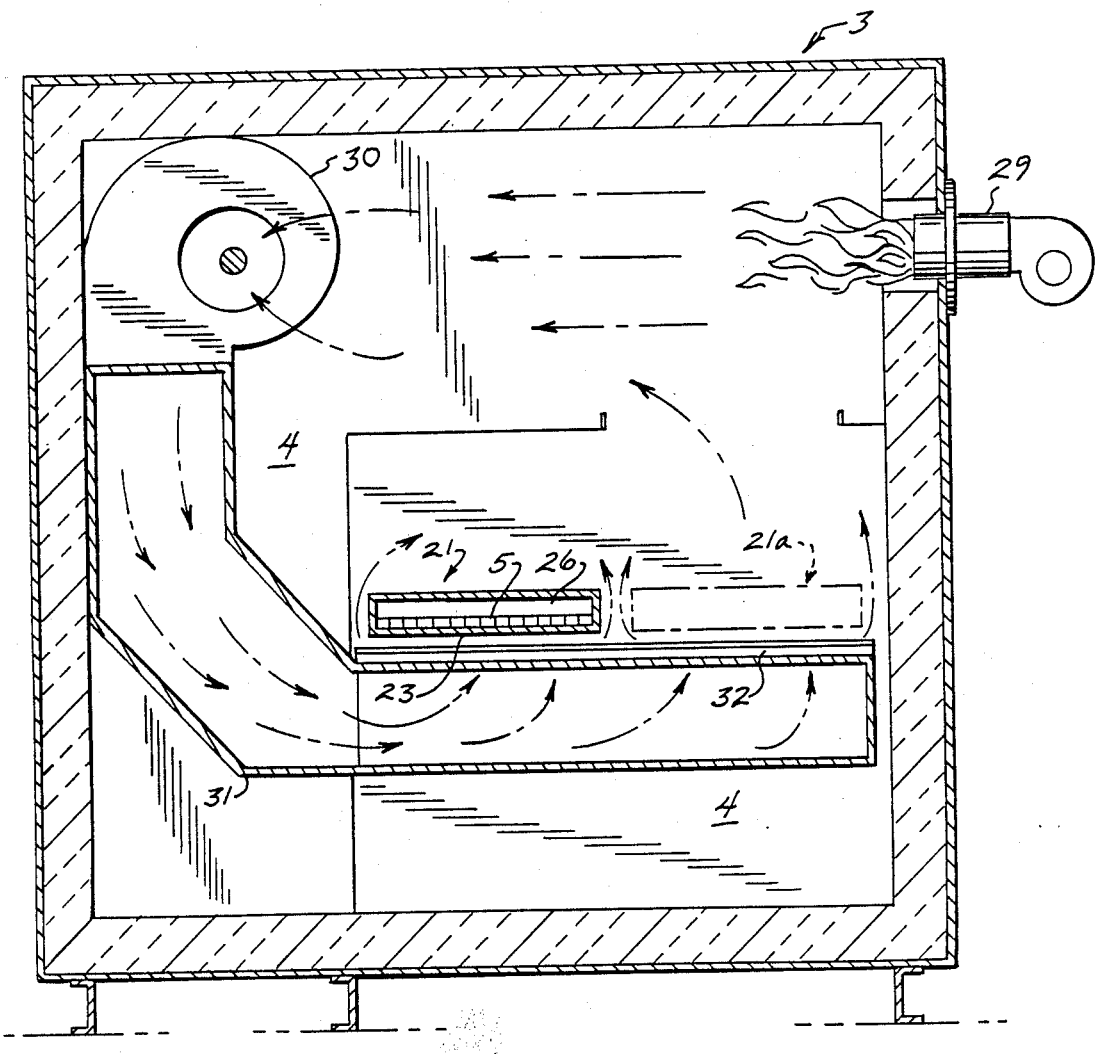
FIG. 2 is a transverse section taken on line 2—2 of FIG. 1.

The various aspects of the invention include the concept of providing heat indirectly to the traveling belt-nugget assembly riding inside muffle 21, through intimate heat conducting contact with muffle bottom wall or floor 23 which is suitably heated outside of muffle chamber 26. FIGS. 1 & 2 illustrate one such form of heating of floor 23, note being made of the arrows which represent air flow. As shown, a source of heat such as a gas burner 29 is disposed in one oven wall and serves to bring in ambient air to chamber 4 and to heat it as well as recirculated air to a suitable temperature. A recirculation blower 30 forces the heated air downwardly through a passage 31 which extends beneath muffle 21. A plurality of upwardly extending transverse air slots or vents 32 are disposed in the upper wall of passage 31 and directly beneath muffle floor 23. The heated air discharges against the bottom surface of floor 23 to provide the desired heating and drying effect within muffle chamber 26, as will be further described.

The arrangement is such that heated air discharging from vents 32 against floor 23 tends to pass back to blower 30 and be recirculated within the system. A small amount of air passes outwardly from passage 31 through a bleed conduit 33 which in turn leads to a mixing box 34. Ambient air enters the downstream end of muffle 21, and after taking up moisture from the drying nuggets 19, discharges from muffle 21 through a further passage 35 which also leads to mixing box 34. A second or exhaust blower 36 driven by a motor, not shown, pulls air from mixing box 34 and causes it to discharge to the outside of oven 3, as at 37. A motor 38 is suitably connected to drive blower 30.

As the sludge-carrying belt transverses through muffle 21, nuggets 19 are in intimate surface contact with floor 23, as are the edges of belt walls 6. Floor 23 is heated by the hot air discharging through vents 32. This heat in floor 23 is conducted directly into nuggets 19 from the floor. Furthermore, heat in floor 23 is conducted into belt walls 6, which are also in intimate surface contact with nuggets 19, so that the heat is also ultimately transferred from walls 6 into the nuggets.

By using muffle floor 23 as a warming plate underneath the traveling belt 5, the resultant temperature of the nuggets will be substantially lower than with prior direct heating methods, such as 300 degrees F. or less. Formation of toxic gases is essentially eliminated. At the same time, moisture is released from sludge nuggets 19 into the air passing upstream through muffle 21 and ultimately discharged. This results in drying and volume reduction of the nuggets, as desired. The final nugget moisture content may be as low as, or lower than, 10 percent.

Subsequently, belt 5 with the dried sludge nuggets 19 is discharged from the downstream end of muffle 21. The nuggets may be removed from belt 5 and further processed in any desired manner, such as being deposited into a transverse rotary auger 39.

Various modes of carrying out the invention are contemplated as being within the scope of the following claims which particularly set forth and distinctly claim the subject matter of the invention.

I claim:

1. A method of drying moist metal hydroxide sludge or the like, comprising the steps of:

(a) providing a mass of moist sludge (2), (b) compressing said sludge into a multi-cellular metallic member (5) to thereby form a plurality of unitary sludge nuggets (19) and with each nugget being tightly compacted within an individual cell of said member, (c) and conduction heating (23) said member and nuggets to a sludge drying temperature below a temperature at which toxic gases are formed by the heated nuggets.

2. A method of drying moist metal hydroxide sludge or the like, comprising the steps of:

(a) providing a mass of moist sludge (2), (b) providing a metallic movable belt (5) having a plurality of walled cells (7), (c) compressing (12,13) said moist sludge into said belt to thereby form a plurality of unitary sludge nuggets (19) and with each nugget being tightly compacted within and filling an individual said cell, (d) then moving said belt through a heating zone (3) while conduction heating (23) said belt and nuggets to a sludge drying temperature below a temperature at which toxic gases are formed by the heated nuggets.

3. The method of claim 2 which includes the steps of:

(a) providing a heat source (29) and a generally planar member (23) within said heating zone and with said planar member being remote from said heat source, (b) causing said belt and nuggets to intimately engage said planar member while said belt is moving through said heating zone, (c) and providing heat from said heat source to said planar member so that drying heat is conducted from said planar member to said nuggets.

4. The method of claim 3 in which said heat providing step further causes drying heat to be conducted from said planar member to the walls of said cells and hence to said compacted nuggets.

5. The method of claim 3 which includes the steps of:

(a) providing an oven (3) defining an oven chamber (4), and with said oven forming said heating zone containing said heat source, (b) providing an elongated generally enclosed muffle (21) forming a muffle chamber (26) isolated from said oven chamber, and with said generally planar member (23) forming the floor of said muffle chamber, (c) and said belt moving step includes moving said belt and nuggets through said muffle chamber so that said belt and nuggets are free of direct impingement of heat from said heat source.

6. A device for drying a mass of moist metal hydroxide sludge or the like, comprising, in combination:

(a) a metallic movable belt (5) having a plurality of walled cells (7), (b) means (12,13) for compressing said moist sludge into said belt to thereby form a plurality of unitary sludge nuggets (19) so that each nugget is tightly compacted within and filling an individual said cell, (c) an oven (3) forming a heating zone disposed downstream of said compressing means, (d) means (8,9) to move said belt through said heating zone, (e) means (23) within said zone for conduction heating said moving belt and nuggets to a sludge drying temperature below a temperature at which toxic gases are formed by said heated nuggets, (f) and means (39) downstream of said zone for subsequently processing the dried nuggets.

7. The device of claim 6 which includes:

(a) a heat source (29) in said oven, (b) and an elongated generally enclosed muffle (21) forming a muffle chamber (26) extending through said oven and remote from said heat source, (c) said muffle including a floor (23) for receiving said moving belt thereon, (d) said floor providing said conduction heating means.

8. The device of claim 7 in which said floor comprises combined means to conduct heat from said heat source to said moving nuggets (19) and means to conduct heat from said heat source to the walls of said moving belt (5) for subsequent conduction to said nuggets.

* * * * *

UNITED STATES PATENT AND TRADEMARK OFFICE

CERTIFICATE OF CORRECTION

PATENT NO. : 4,827,853

DATED : May 9, 1989

INVENTOR(S) : Michael F. Emery

It is certified that error appears in the above-identified patent and that said Letters Patent is hereby corrected as shown below:

Column 2, line 13, delete "state" and substitute therefore --stage--.

Signed and Sealed this

Sixth Day of March, 1990

*Attest:*

*Attesting Officer*

JEFFREY M. SAMUELS

*Acting Commissioner of Patents and Trademarks*